US006463677B2

(12) United States Patent
Wolf et al.

(10) Patent No.: US 6,463,677 B2
(45) Date of Patent: Oct. 15, 2002

(54) METHOD AND DEVICE FOR MOISTURE PROFILING

(75) Inventors: Robert Wolf, Herbrechtingen; Markus Oechsle, Bartholomae; Wolfgang Mayer; Roland Mayer, both of Heidenheim; Frank Wegehaupt, Böhmenkirch, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/954,053

(22) Filed: Sep. 18, 2001

(65) Prior Publication Data

US 2002/0043004 A1 Apr. 18, 2002

Related U.S. Application Data

(62) Division of application No. 09/393,690, filed on Sep. 10, 1999.

(30) Foreign Application Priority Data

Sep. 11, 1998 (DE) ..... 198 41 638

(51) Int. Cl.[7] ..... F26B 7/00

(52) U.S. Cl. ..... 34/420; 34/247; 34/255; 34/261; 34/273; 34/422; 34/425; 219/690; 219/695; 219/697; 219/700; 219/701

(58) Field of Search ..... 34/247, 255, 261, 34/273, 420, 422, 425, 459, 110, 111, 620, 623, 624; 219/690, 695, 697, 700, 701, 748, 773, 774, 780

(56) References Cited

U.S. PATENT DOCUMENTS

| | | | | |
|---|---|---|---|---|
| 2,319,174 A | * | 5/1943 | Wilson | 34/250 |
| 3,952,421 A | | 4/1976 | Wilson et al. | |
| 4,188,731 A | | 2/1980 | Rauskolb | |
| 4,738,752 A | | 4/1988 | Busker et al. | |
| 4,882,852 A | | 11/1989 | Kautto | |
| 5,064,979 A | | 11/1991 | Jaeger | |
| 5,424,518 A | | 6/1995 | Gustafsson | |
| 5,536,921 A | | 7/1996 | Hederick et al. | |
| 5,659,972 A | | 8/1997 | Min et al. | |
| 5,813,134 A | | 9/1998 | Min et al. | |
| 5,862,613 A | * | 1/1999 | Kerttula et al. | 34/446 |

FOREIGN PATENT DOCUMENTS

| | | |
|---|---|---|
| AU | 445577 | 2/1974 |
| CA | 1107495 | 8/1981 |
| DE | 691038 | 5/1940 |
| DE | 694637 | 8/1940 |

(List continued on next page.)

*Primary Examiner*—William C. Doerrler
*Assistant Examiner*—Mark Shulman
(74) *Attorney, Agent, or Firm*—Greenblum & Bernstein, P.L.C.

(57) ABSTRACT

Method and device for moisture profiling of fibrous material web to be dried in machines for manufacturing and/or refining of fibrous material web. Method includes subjecting fibrous material web to electromagnetic waves in the form of high-frequency waves. Device includes a fibrous material web support that supports travel of fibrous material web and a rotating cylinder. Rotating cylinder receives fibrous material web from fibrous material web support, and fibrous material web support is arranged outside fibrous material web in relation to the surface of the rotating cylinder. At least one electromagnetic wave transmitter is also included. Rotating cylinder conveys fibrous material web past the at least one electromagnetic wave transmitter, electromagnetic wave transmitter produces electromagnetic waves laterally to material fibrous web, and electromagnetic waves balances out moisture variances laterally to fibrous material web by drying moister areas of fibrous material web more intensely than dried areas of fibrous material web.

20 Claims, 1 Drawing Sheet

FOREIGN PATENT DOCUMENTS

| | | |
|---|---|---|
| DE | 697509 | 10/1940 |
| DE | 1959116 | 4/1967 |
| DE | 2545592 | 4/1976 |
| DE | 2816551 | 10/1979 |
| DE | 3445615 | 6/1986 |
| DE | 4121203 | 1/1993 |
| EP | 248866 | 12/1987 |
| GB | 1027589 | 4/1966 |
| WO | 92/12291 | 7/1992 |
| WO | 97/13110 | 4/1997 |

* cited by examiner

METHOD AND DEVICE FOR MOISTURE PROFILING

CROSS-REFERENCE TO RELATED APPLICATIONS

The present application is a Divisional of U.S. patent application Ser. No. 09/393,690, filed Sep. 10, 1999, and claims priority under 35 U.S.C. §119 of German Patent Application No. 198 41 638.5, filed Sep. 11, 1998, the disclosures of which are expressly incorporated by reference herein in their entireties.

BACKGROUND OF THE INVENTION

1. Field of the Invention

The invention relates to methods and associated devices for the moisture profiling of a fibrous material web to be dried, and more specifically to the moisture profiling of a paper, cardboard, or tissue web, in machines for manufacturing or refining this web.

2. Discussion of Background Information

Currently, fibrous material webs are guided by a heated cylinder for drying. In this costly process, an uneven distribution of moisture, laterally to the fibrous material web, often sets in. To correct this moisture cross direction profile, particular zones are additionally moistened or heated. The heating generally takes place inductively or by IR radiator (s). The moistening is carried out with steam. However, these corrective measures are relatively imprecise. Furthermore, the measurement and regulation of the moisture profile is very costly.

SUMMARY OF THE INVENTION

Accordingly, the present invention is directed to a method and device for moisture profiling of a fibrous material web to be dried that substantially obviates one or more of the problems arising from the limitations and disadvantages of the related art.

In particular, the present invention to provides a method and device for moisture profiling that is as simple and precise as possible.

Further, the present invention provides a method and device for moisture profiling that balances out moisture variances laterally to a fibrous material web.

Accordingly, one aspect of the present invention is directed to a method for moisture profiling of a fibrous material web to be dried in machines for manufacturing and/or refining this web that includes subjecting the fibrous material web to electromagnetic waves in the form of microwaves and/or high-frequency waves.

According to another aspect of the present invention, the field energy of the electromagnetic waves are distributed as evenly as possible laterally to the fibrous material web.

According to yet another aspect of the present invention, the electromagnetic waves are used when there is a dry matter content of the fibrous material web between approximately 60 and 95%.

In a further aspect of the present invention, the fibrous material web travels in a supported manner at least in the vicinity of the electromagnetic waves.

According to another aspect of the present invention, a drying of the fibrous material web may be produced at least predominantly by the electromagnetic waves.

According to yet another aspect of the present invention, the drying of the fibrous material web may be produced only to a small degree by the electromagnetic waves. The drying of the fibrous material web preferably serving to balance out moisture variances laterally to the fibrous material web.

In a further aspect of the present invention, the fibrous material web may be conveyed past at least one microwave transmitter.

According to another aspect of the present invention, the microwave transmitter includes at least one wave guide respectively connected to at least one microwave source.

According to yet another aspect of the present invention, the wave guides are distributed evenly laterally to the fibrous material web.

In a further aspect of the present invention, the fibrous material web may be guided by a rotating cylinder in the vicinity of a microwave transmitter.

According to another aspect of the present invention, the casing of the rotating cylinder and/or an outer cover of this casing may be composed of a material which does not absorb the microwaves as well as the fibrous material web.

According to yet another aspect of the present invention, the thickness of the outer cover may be between approximately 5 and 150 mm.

In a further aspect of the present invention, the thickness of the outer cover may be between approximately 10 and 50 mm.

According to another aspect of the present invention, the travel of the fibrous material web may be supported by at least one wire. The material of the at least one wire not absorbing the microwaves as well as the fibrous material web.

According to yet another aspect of the present invention, the fibrous material web may be conveyed past at least two electrodes of different polarity that are connected to a high-frequency source.

In a further aspect of the present invention, the electrodes have the form of bar electrodes, capacitor plates, and/or rotating cylinders.

According to another aspect of the present invention, the fibrous material web may be guided by a rotating cylinder in the vicinity of the electrodes. The fibrous material web preferably is supported by a wire.

According to yet another aspect of the present invention, the rotating cylinder is preferably embodied predominantly of metal. The rotating cylinder constitutes an electrode and a bar electrode and/or a capacitor plate of a different polarity arranged on the opposite side in relation to the fibrous material web.

In a further aspect of the present invention, the rotating cylinder has an electrically insulating outer cover.

According to another aspect of the present invention, the invention includes at least two bar electrodes of different polarity in the winding region of the rotating cylinder. The high-frequency waves of the at least two bar electrodes partially penetrate the fibrous material web.

According to yet another aspect of the present invention, the device has an electromagnetic shield.

In a further aspect of the present invention the invention is directed to a method for moisture profiling of a fibrous material web to be dried that includes conveying a fibrous material web past at least one electromagnetic wave source. The fibrous material web may be subjected to electromagnetic waves from the at least one electromagnetic wave source. Moister areas of the fibrous material web are dried more intensely than dried areas of the fibrous material web. The drying may be caused by the electromagnetic waves.

According to another aspect of the present invention, the electromagnetic waves include microwaves and/or high-frequency waves.

According to yet another aspect of the present invention, the electromagnetic wave source includes a microwave transmitter and/or at least two electrodes of different polarity connected to a high-frequency source.

In a further aspect of the present invention, the field energy of the electromagnetic waves may be distributed evenly laterally to the fibrous material web. The even distribution produces a uniform drying action on the fibrous material web.

In a still further aspect of the present invention, moisture variances may be balanced out laterally to the fibrous material web by the drying.

According to another aspect of the present invention the invention is directed to a device for moisture profiling of a fibrous material web to be dried in machines for manufacturing and/or refining this web that includes a fibrous material web support that supports travel of the fibrous material web. Also, the device includes a rotating cylinder where the rotating cylinder receives the fibrous material web from the fibrous material web support. The fibrous material web support may be arranged outside the fibrous material web in relation to the surface of the rotating cylinder. The device further includes at least one electromagnetic wave transmitter. The rotating cylinder conveys the fibrous material web past the at least one electromagnetic wave transmitter. The electromagnetic wave transmitter produces electromagnetic waves laterally to the material fibrous web. The electromagnetic waves balance out moisture variances laterally to the fibrous material web by drying moister areas of the fibrous material web more intensely than dried areas of the fibrous material web.

According to yet another aspect of the present invention, the fibrous material web support includes at least one wire whose material does not absorb the electromagnetic waves as well as the fibrous material web.

In a further aspect of the present invention, the rotating cylinder has an outer cover. The outer cover may be composed of a material that does not absorb the electromagnetic waves as well as the fibrous material web.

According to another aspect of the present invention, the outer cover material may be Teflon (polytetrafluorethylene).

According to yet another aspect of the present invention, the at least one electromagnetic wave transmitter includes a microwave transmitter and/or at least two electrodes of different polarity connected to a high-frequency source.

In a further aspect of the present invention, the at least one electromagnetic wave transmitter may be evenly distributed laterally to the fibrous material web.

According to another aspect of the present invention, the at least two electrodes of different polarity connected to a high-frequency source may include bar electrodes, capacitor plates, and/or the rotating cylinder.

According to yet another aspect of the present invention, the microwave transmitter includes an alignment of a plurality of wave guides having a rectangular cross section. The waves guides may be connected to a microwave source and extend laterally to the web travel direction.

In a further aspect of the present invention, the outer cover may be electrically insulating.

According to another aspect of the present invention, the bar electrodes and capacitor plates may be arranged in a winding region of the rotating cylinder and extend essentially laterally to the fibrous material web and parallel to the rotating cylinder.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
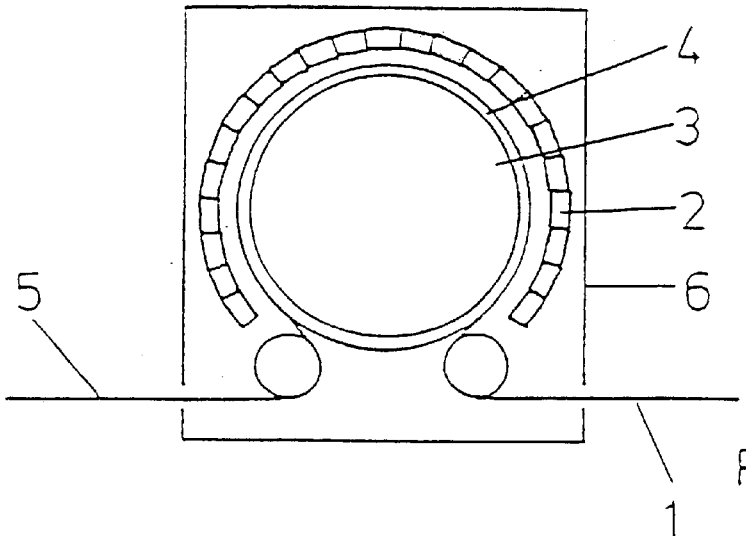
FIG. 1 illustrates a cross section of a cylinder and a microwave device of a device for moisture profiling of a fibrous material web according to the present invention.

The particulars shown herein are by way of example and for purposes of illustrative discussion of the embodiments of the present invention only and are presented in the cause of providing a useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

According to the invention, the fibrous material web is subjected to electromagnetic waves in the form of microwaves and/or high-frequency waves. This occurs by the fibrous material web being conveyed past at least one microwave transmitter and/or at least two electrodes of different polarity that are connected to a high-frequency source. The use of electromagnetic waves produces a self-regulating action since moister areas of the fibrous material web are dried more intensely. This is based on the fact that water absorbs these waves more intensely than the dried paper, i.e., its fibers.

Since the dielectric of the water in this connection is subjected to an electrical field, a polarization occurs, i.e., the shifting of charged particles from the equilibrium position. This polarization leads to losses, which lead to a heating of the water. The high-frequency range lies in the range between approximately 10 and 300 MHZ. The microwave range lies between approximately 300 MHZ and 30 GHz.

In order to assure a uniform action on the fibrous material web, the field energy of the electromagnetic waves laterally to the fibrous material web should also be as evenly distributed as possible.

The process according to the present invention is used in areas in which the fibrous material web has a dry matter content between approximately 60% and 95%. In these areas, on the one hand, not too much water needs to be heated but, on the other hand, a sufficient degree of moisture is available to absorb the electromagnetic waves.

Particularly at high speeds, it is advantageous if the fibrous material web also travels in a supported manner in the vicinity of the electromagnetic waves. This stabilizes the travel of the fibrous material web and reduces the danger of tears. To this end, the fibrous material web may be guided by a rotating cylinder.

Depending on the type of fibrous material web and/or the type of machine, it is easily possible for the drying of the fibrous material web to occur at least predominantly by electromagnetic waves. Usually, however, the drying takes place in a conventional manner, i.e., for example, by heated cylinders, so that electromagnetic waves essentially serve only to balance out moisture differences laterally to the fibrous material web.

Preferably, one or more wave guides are used as microwave transmitters, which are each connected to at least one microwave source and should be distributed as evenly as possible laterally to the fibrous material web. As a result, this produces a relatively even distribution of the field energy of the microwaves laterally to the fibrous material web.

For support, the fibrous material web may be guided by a rotating cylinder in the region of the microwaves. Since the cylinders, which are usually metallic, would cause a reduction of the field energy of the microwaves in the fibrous material web, the casing of the cylinder or an outer cover of the casing should be composed of a material that does not absorb the microwaves as well as the fibrous material web. Teflon (polytetrafluorethylene), for example, is suitable for this. The thickness of the cover should lie between approximately 5 and 150 mm, preferably between approximately 10 and 50 mm.

The travel of the fibrous material web, however, may also be supported by itself or be supported in a supplementary manner by at least one wire whose material does not absorb the microwaves as well as the fibrous material web.

In the case in which high-frequency waves are used, the electrodes should have the form of bar electrodes, capacitor plates, and/or rotating cylinders. In this instance as well, the fibrous material web should be guided by means of a rotating cylinder and preferably supported by a wire in the vicinity of the electrodes.

Therefore, it is possible that the cylinder, which is preferably embodied predominantly of metal, constitutes an electrode and at least one bar electrode and/or a capacitor plate of a different polarity is arranged on the opposite side in relation to the fibrous material web. As a protective measure, it is advantageous if the cylinder has an electrically insulating outer cover. On the other hand, however, it is also possible for at least two bar electrodes of different polarities to be arranged in the winding region of the cylinder, whose high-frequency waves partially penetrate the fibrous material web. Independent of the type of waves, which may also be used in combination with one another, these devices should be electromagnetically shielded from the environment.

All of the figures of the present invention show a cross section through a cylinder 3 with the device according to the invention, where the fibrous material web 1 winds around most of the circumference of the rotating cylinder 3. In this case, cylinder 3 is not heated separately.

As shown in FIG. 1, a microwave transmitter 2 is arranged outside of cylinder 3, along the winding region. Microwave transmitter 2 includes an alignment of a number of wave guides which have a rectangular cross section. The wave guides extend laterally to the web travel direction, and are respectively connected to a microwave source (not shown). However, it is also possible to dispose the wave guides in a meandering form. The microwaves coming from them assure that the moister areas of the fibrous material web 1 are more intensely heated and, therefore, more intensely dried than the other areas. This results in a uniform moisture profile.

A shield 6 is arranged around microwave transmitter 2 so that no microwaves can escape this device. The cylinder 3 has an approximately 2 cm thick cover 4 made of Teflon (polytetrafluorethylene), which does not absorb the microwaves as intensely as the fibrous material web 1. The thickness of the cover 4 assures that the metallic region of the cylinder 3 is arranged away from the fibrous material web 1 such that as high a field intensity of the microwaves as possible is assured in the fibrous material web 1.

The travel of the fibrous material web 1 is stabilized by a wire 5, which travels along with it. Wire 5 is arranged outside the fibrous material web 1 in relation to the surface of cylinder 3, and is likewise comprised of a material which absorbs the microwaves less intensely than the fibrous material web 1.

Figure 2:
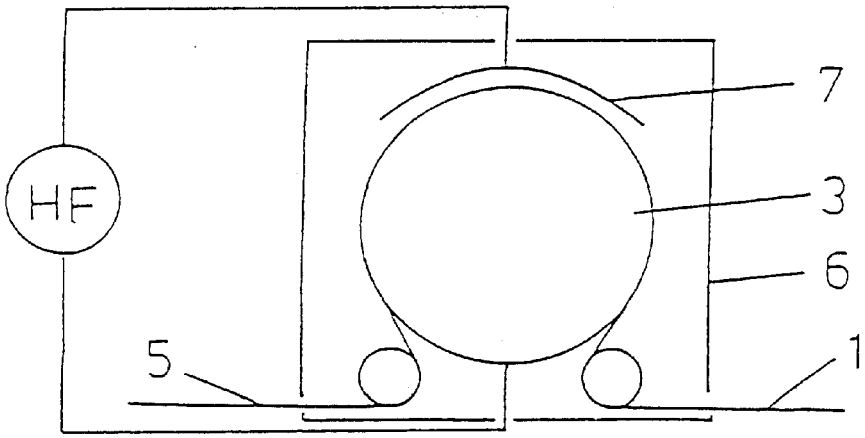
FIG. 2 illustrates a cross section of a cylinder and a high-frequency device with a capacitor plate of a device for moisture profiling of a fibrous material web according to the present invention.
Figure 3:
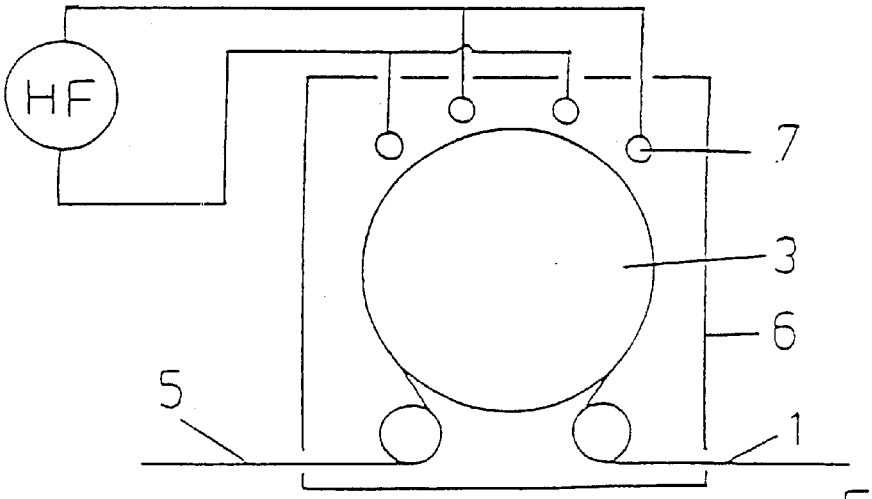
FIG. 3 illustrates a cross section of a cylinder and a high-frequency device with bar electrodes of a device for moisture profiling of a fibrous material web according to the present invention.

FIGS. 2 and 3 show high-frequency devices in which the travel of the fibrous material web 1 is stabilized by a wire 5 that is arranged outside it and travels along with it. In addition, the devices in FIGS. 2 and 3 are also provided with a shield 6 for the high-frequency waves. However, the fibrous material web 1 is conveyed past electrodes of different polarities that are connected to a high-frequency (HF) source. This leads to the heating and drying of the moist areas of the fibrous material web 1, resulting in a relatively even moisture cross direction profile.

In FIG. 2, metallic rotating cylinder 3 itself constitutes an electrode 7 connected to the high-frequency source. An electrode of the opposite polarity from electrode 7 is constituted by a capacitor plate which is arranged in the winding region of cylinder 3. The high-frequency waves thereby penetrate the fibrous material web 1, which renders the device very effective. Because of the function of cylinder 3 as an electrode 7, it should have an electrically insulating cover in the region of the moist fibrous material web 1.

In contrast to FIG. 2, all of the electrodes 7 in FIG. 3 are bar electrodes, which are arranged in the winding region of cylinder 3. The electrodes connected to a high-frequency (HF) source are polarized so that adjacent bar electrodes always have different polarities. The field produced between the electrodes 7 thereby penetrates the fibrous material web 1 at least partially, which leads to the heating and drying of the moist areas of the fibrous material web 1. The bar electrodes and the capacitor plates arranged in the winding region of cylinder 3 extend essentially laterally to the fibrous material web 1 and parallel to the cylinder 3.

The moisture profiling devices according to the present invention may be provided at a number of locations of a paper-making or coating machine. Furthermore, the entire drying process may be realized in this way. Preferably, however, moisture profiling devices of this kind are used for correcting the moisture cross direction profile in drying sections with conventionally heated drying cylinders, which are wound around by the fibrous material web.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular means, materials, and embodiments, the present invention is not intended to be limited to the particulars disclosed herein, rather, the present invention extends to all functionally equivalent structures, methods and uses, such as are within the scope of the appended claims.

What is claimed:

1. A method for moisture profiling of a fibrous material web to be dried in machines for at least one of manufacturing and refining this web comprising:

creating electromagnetic waves in the form of high-frequency waves between at least two electrodes of different polarity; and subjecting the fibrous material web to the electromagnetic waves in the form of high-frequency waves.

2. The method according to claim 1, the field energy of the electromagnetic waves being distributed as evenly as possible laterally to the fibrous material web.

3. The method according to claim 1, the electromagnetic waves being used when there is a dry matter content of the fibrous material web between approximately 60 and 95%.

4. The method according to claim 1, the fibrous material web traveling in a supported manner at least in the vicinity of the electromagnetic waves.

5. The method according to claim 1, a drying of the fibrous material web being produced at least predominantly by the electromagnetic waves.

6. The method according to claim 5, the drying of the fibrous material web comprising heating and drying moist areas of the fibrous material web by the electromagnetic waves, whereby the drying of the fibrous material web balances out moisture variances laterally to the fibrous material web.

7. A method for moisture profiling of a fibrous material web to be dried comprising:

conveying a fibrous material web past at least one electromagnetic wave source comprising at least two electrodes of different polarity;

subjecting the fibrous material web to electromagnetic waves from the at least one electromagnetic wave source; and drying moister areas of the fibrous material web more intensely than dried areas of the fibrous material web, the drying caused by the electromagneticwaves.

8. The method according to claim 7, wherein the electromagnetic waves comprise high-frequency waves.

9. The method according to claim 7, the electromagnetic wave source further comprising a high-frequency source coupled to the at least two electrodes of different polarity.

10. The method according to claim 7, comprising distributing evenly the field energy of the electromagnetic waves laterally to the fibrous material web, the even distribution producing a uniform drying action on the fibrous material web.

11. The method according to claim 7, comprising balancing out moisture variances laterally to the fibrous material web by the drying.

12. A device for moisture profiling of a fibrous material web to be dried in machines for at least one of manufacturing and refining this web comprising:

a fibrous material web support that supports travel of the fibrous material web;

a rotating cylinder, the rotating cylinder receiving the fibrous material web from the fibrous material web support, the fibrous material web support arranged outside the fibrous material web in relation to the surface of the rotating cylinder; and at least one electromagnetic wave transmitter comprising at least two electrodes at different polarities, the rotating cylinder conveying the fibrous material web past the at least one electromagnetic wave transmitter, the electromagnetic wave transmitter producing electromagnetic waves laterally to the material fibrous web, the electromagnetic waves balancing out moisture variances laterally to the fibrous material web by drying moister areas of the fibrous material web more intensely than dried areas of the fibrous material web.

13. A device for moisture profiling of a fibrous material web to be dried in machines for manufacturing and/or refining this web comprising:

a fibrous material web support that supports travel of the fibrous material web;

a rotating cylinder, the rotating cylinder receiving the fibrous material web from the fibrous material web support, the fibrous material web support arranged outside the fibrous material web in relation to the surface of the rotating cylinder; and at least one electromagnetic wave transmitter, the rotating cylinder conveying the fibrous material web past the at least one electromagnetic wave transmitter, the electromagnetic wave transmitter producing electromagnetic waves laterally to the material fibrous web, the electromagnetic waves balancing out moisture variances laterally to the fibrous material web by drying moister areas of the fibrous material web more intensely than dried areas of the fibrous material web, wherein the fibrous material web support comprises at least one wire whose material does not absorb the electromagnetic waves as well as the fibrous material web.

14. A device for moisture profiling of a fibrous material web to be dried in machines for manufacturing and/or refining this web comprising:

a fibrous material web support that supports travel of the fibrous material web;

a rotating cylinder, the rotating cylinder receiving the fibrous material web from the fibrous material web support, the fibrous material web support arranged outside the fibrous material web in relation to the surface of the rotating cylinder; and at least one electromagnetic wave transmitter, the rotating cylinder conveying the fibrous material web past the at least one electromagnetic wave transmitter, the electromagnetic wave transmitter producing electromagnetic waves laterally to the material fibrous web, the electromagnetic waves balancing out moisture variances laterally to the fibrous material web by drying moister areas of the fibrous material web more intensely than dried areas of the fibrous material web, wherein the rotating cylinder has an outer cover composed of a material that does not absorb the electromagnetic waves as well as the fibrous material web.

15. The device according to claim 14, the material comprising polytetrafluorethylene.

16. The device according to claim 14, the outer cover being electrically insulating.

17. The device according to claim 12, the at least one electromagnetic wave transmitter further comprising a high-frequency source coupled to said at least two electrodes of different polarity.

18. The device according to claim 17, the at least two electrodes of different polarity connected to a high-frequency source comprising at least one of bar electrodes, capacitor plates, and the rotating cylinder.

19. The device according to claim 18, the bar electrodes and capacitor plates being arranged in a winding region of the rotating cylinder and extending essentially laterally to the fibrous material web and parallel to the rotating cylinder.

20. The device according to claim 12, the at least one electromagnetic wave transmitter evenly distributed laterally to the fibrous material web.

* * * * *